US006726206B2

(12) United States Patent
Brown

(10) Patent No.: US 6,726,206 B2
(45) Date of Patent: Apr. 27, 2004

(54) TURTLEDICE ISLAND BOARD GAME

(76) Inventor: Donald J. Brown, P.O. Box 403172, Hesperia, CA (US) 92340

( * ) Notice: Subject to any disclaimer, the term of this patent is extended or adjusted under 35 U.S.C. 154(b) by 0 days.

(21) Appl. No.: 09/948,365

(22) Filed: Sep. 7, 2001

(65) Prior Publication Data

US 2003/0047873 A1 Mar. 13, 2003

(51) Int. Cl.[7] ..... A63F 3/00

(52) U.S. Cl. ..... 273/236; 273/283; 273/287; 273/288

(58) Field of Search ..... 273/284, 288, 273/266, 263, 264, 290, 236, 239, 241, 242, 283

(56) References Cited

U.S. PATENT DOCUMENTS

| | | | | | |
|---|---|---|---|---|---|
| D34,678 | S | | 6/1901 | Wegmann | |
| 1,362,318 | A | * | 12/1920 | Hydes | |
| 1,558,165 | A | * | 10/1925 | Haswell | |
| 2,981,009 | A | * | 4/1961 | Lindquist | |
| 3,547,444 | A | | 12/1970 | Williams | |
| 3,638,947 | A | * | 2/1972 | Hardesty | 273/273 |
| 3,829,098 | A | | 8/1974 | Umminger, Jr. | |
| 3,877,703 | A | * | 4/1975 | Pierre | 273/153 R |
| 3,964,747 | A | * | 6/1976 | Balmforth | 273/131 |
| 4,146,235 | A | * | 3/1979 | Brautovich | 273/273 |
| 4,190,256 | A | * | 2/1980 | Rudden, Jr. | 273/275 |
| 4,199,145 | A | | 4/1980 | Gouraige, Jr. | |
| 4,331,333 | A | * | 5/1982 | Willcocks | 273/238 |
| 4,445,692 | A | * | 5/1984 | Boyle | 273/256 |
| 4,550,915 | A | * | 11/1985 | Meyer | 273/272 |
| 6,070,871 | A | * | 6/2000 | Wilson et al. | 273/261 |

* cited by examiner

*Primary Examiner*—S. Thomas Hughes
*Assistant Examiner*—Alex F. R. P. Rada, II
(74) *Attorney, Agent, or Firm*—Sheldon & Mak; Denton L. Anderson

(57) ABSTRACT

A board game includes hexagonal game pieces that are rotatable between discrete orientations at array locations on a game board as well as being movable between array locations, with game outcomes being dependent on facing indicia of adjacent game pieces of opposing players. Exemplary game pieces are hexagonal representations of turtles, the game board array locations also being hexagonal. Edge margin segments of each game piece have associated indicia representing the integers 1 through 6, and a moving piece having equal or superior indicia facing an opposing piece can "take" the opposing piece. Also disclosed is a method for using the board game.

32 Claims, 3 Drawing Sheets

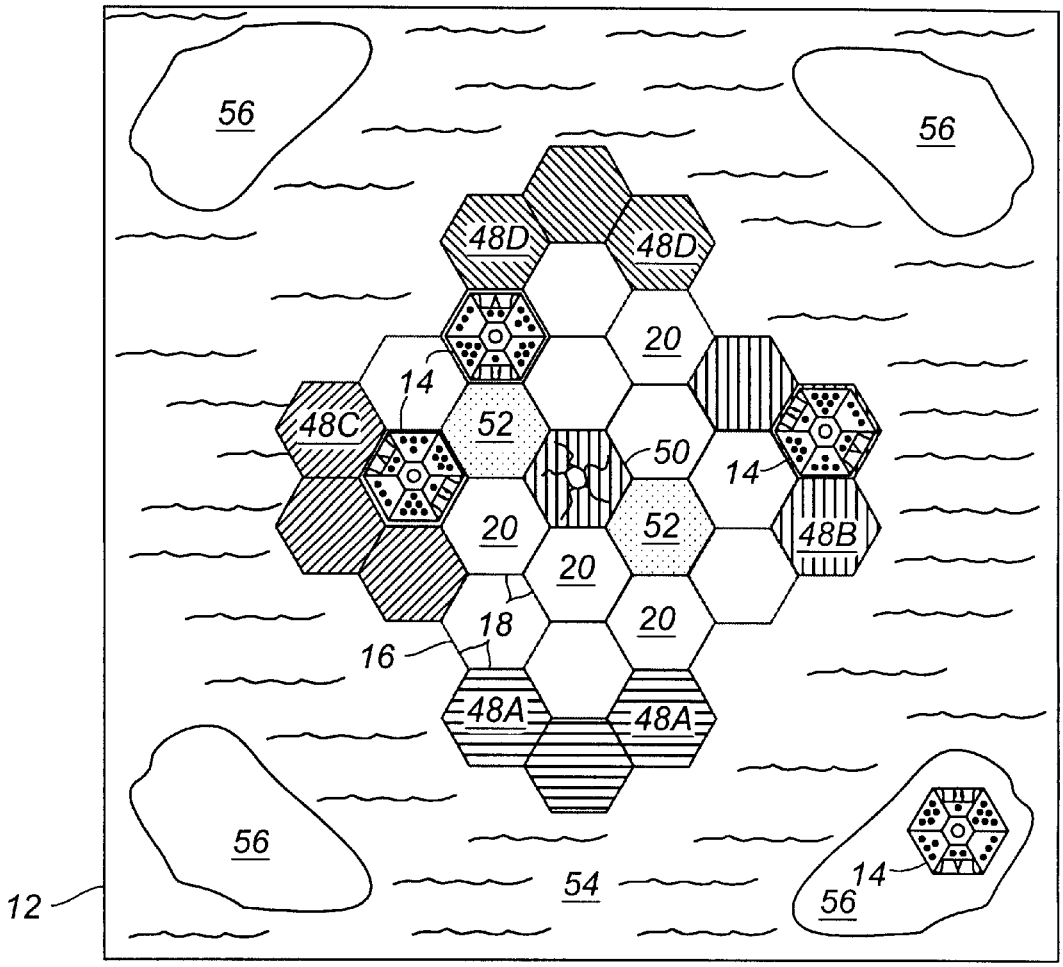
10 Fig. 11.

TURTLEDICE ISLAND BOARD GAME

BACKGROUND

The present invention relates to board games of the type wherein game pieces of opposing players are moveable in multiple directions between discrete game board positions.

Well known board games include Checkers, in which identical pieces move diagonally forward in alternating board squares, but can also move backward once being promoted to "king" by reaching an opposite board boundary. In Chess, different pieces have different symmetrical movement choices among all board squares, except that pawns only move forward (diagonally forward when "taking" an opponent's piece) until being promoted to a different piece of the player's choice upon reaching the opposite board boundary. In both of these games opponent's pieces are removed (by being "taken" in Chess, the taking piece occupying the square formally occupied by the taken piece—by being "jumped" in checkers, the square formerly occupied by the jumped piece being left empty). In Chinese Checkers, a player's piece can jump his own as well as an opponent's pieces, the jumped pieces remaining in place. Objects of these games include capturing all of the opponent's pieces (Checkers), successfully attacking the opponent's king (Chess), and moving all of one's pieces to an opposite region of the board (Chinese Checkers.

There is a perception that traditional board games such as those discussed above have become less popular in recent years, and one possible reason for this is the somewhat narrow constraints that are imposed on the movement of pieces. For example, a piece in Chinese Checkers (and an unpromoted piece in ordinary Checkers) can move to one of only two adjacent positions (diagonally forward), unless jumping is involved. *(Other possibilities in Chinese checkers? Rarely advantageous?)* Similarly, pawns in chess can move straight forward only one square per turn (optionally two squares on the first move), and can only go diagonally one square when taking an opponent's piece. Another disadvantage with many traditional board games is that only one game (or set of rules) applies to the game, no alternate set of rules (or game objective) has been found to have practical application. It is known, however, to use the same board for both Checkers and Chess (with different game pieces), and to use the same pieces for both Checkers and Backgammon (with different boards. There is little else in common between games that are so paired. Accordingly, only a small proportion of the respective game sets are believed to be used significantly for both games of the respective pairs.

Thus there is a need for a board game having movement direction of game pieces as a major strategic element for enhancing and prolonging player attraction to the game, and further to provide plural game choices that involve significant common strategy elements.

SUMMARY

The present invention meets this need by providing a board game in which movements of game pieces between game-board positions is limited by previously selected orientations of the pieces. Typical implementations of the game allow multiple directions of piece movement as subsets of all possible directions of movement, the subsets being preferably planned for and selected in advance. Further, the apparatus is adapted for a plurality of game formats having both the same board layout and the same or nearly the same piece movement protocol. In one aspect of the invention, the game apparatus includes a plurality of game pieces of non-circular plan outline, including at least two visually distinguishable types of the game pieces to be moved by the players, respective segments of the plan outline of each game piece having corresponding orientation indicia associated therewith, the orientation indicia of at least two of the segments being distinguishable from each other; a game board having play region indicia defining an array of game piece positions and orientations, respective array elements of the array enclosing the plan outline of a game piece placed therein in one of a plurality of discrete orientations, whereby a comparison of facing orientation indicia of opposing game pieces occupying adjacent game piece positions is operable as an outcome determining factor of games played by the apparatus.

The plan outline of each of the game pieces can be polygonal, the array elements of the array being correspondingly polygonal. The orientation indicia of each game piece can represent different numerical values. The plan outline can be hexagonal, the array elements being hexagonal. The orientation indicia of each game piece can represent the integers 1 through 6.

Preferably each of the game pieces is configured with the plan outline having a front portion and a back portion for signifying respective forward and backward movement directions of the game piece, the front portion including left and right shoulder segments and a front segment of the plan outline, the back portion including left and right hip segments and a rear segment of the plan outline. The orientation indicia associated with the shoulder segments of each game piece can be superior to the orientation indicia associated with the hip segments. The integers 1 through 6 can be associated with the front, rear, shoulder, and hip edge margins, respectively.

Preferably each of the game pieces is configured with the plan outline having a front portion and a back portion for signifying respective forward and backward movement directions of the game piece. Each of the game pieces can be configured with a head portion in association with the front portion of the plan outline and a tail portion in association with the back portion of the plan outline. Each of the game pieces can be configured for depicting a turtle, which can include a shell formation extending to proximate the plan outline. The shell formation can include six shell faces having the game piece indicia thereon.

Preferably the array elements of the game board define respective home positions for the visually distinguishable types of game pieces. The home positions can be at perimeter extremities of the array.

The array elements of the game board can define a hazard element signifying restricted mobility of a game piece located thereon. The array elements of the game board can define include a trap element signifying further restricted mobility of a game piece located thereon.

Preferably each of the game pieces further includes an upstanding stem portion approximately centrally located thereon for facilitating manipulation of the game piece. Each of the game pieces is also preferably formed with an upwardly extending registration cavity for engaging the stem portion of another of the game pieces in stacked relation.

In another aspect of the invention, a method for playing a board game by opposing players includes:

(a) providing a plurality of game pieces of non-circular plan outline, including at least two visually distinguishable types of the game pieces to be moved by the players, respective segments of each piece proximate the plan outline thereof having corresponding orientation indicia associated therewith, the orientation indicia of at least two of the segments being distinguishable from each other;

(b) providing a game board having play region indicia defining an array of game piece positions and orientations, respective array elements of the array enclosing the plan outline of a game piece placed therein in one of a plurality of discrete orientations;

(c) selectively rotating a selected game piece in an array element occupied by the game piece from an initial one of the discrete orientations to a different one of the orientations;

(d) selectively moving a selected game piece from an array element occupied by the game piece to a different array element;

(e) comparing facing orientation indicia of opposing game pieces occupying adjacent game piece positions, if any; and (f) determining an outcome of the game resulting from the comparing.

The method can further include removing one of the opposing game pieces based on the outcome, and moving the other of the opposing game pieces to the array element previously occupied by the removed game piece. The method can further include providing one of the array elements as a hazard element, and limiting at least one aspect of the selectively rotating and selectively moving of a game piece occupying the hazard element. The limiting can include preventing the selectively rotating. The method can further include providing one of the array elements as a trap element and further limiting the selectively rotating and/or the selectively moving of a game piece occupying the trap element. The further limiting can include preventing both the selectively rotating and the selectively moving.

DRAWINGS

These and other features, aspects, and advantages of the present invention will become better understood with reference to the following description, appended claims, and accompanying drawings, where:

FIG. 11 is a plan view showing an alternative configuration of the game board of FIG. 1.

DESCRIPTION

Figure 1:
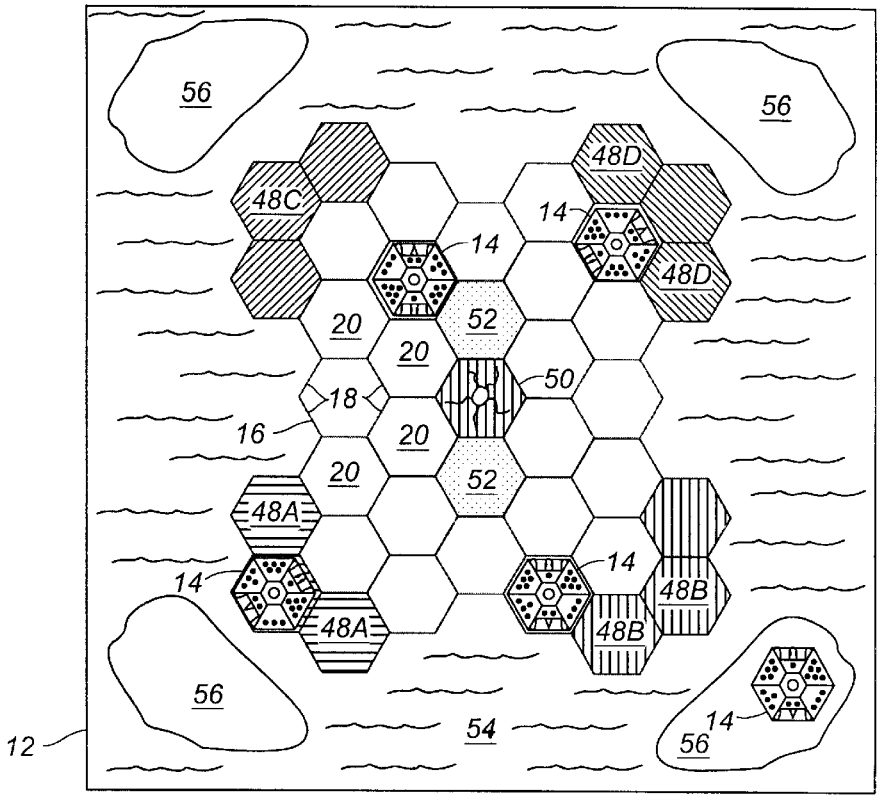
FIG. 1 is a plan view of a board game apparatus according to the present invention, showing game pieces in typical positions on a game board.
Figure 2:
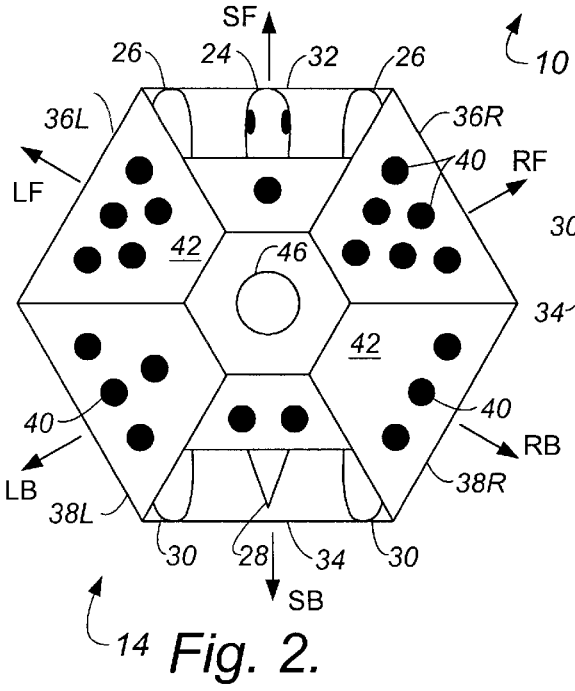
FIG. 2 is a detail plan view of one of the game pieces of FIG. 1.
Figure 3:
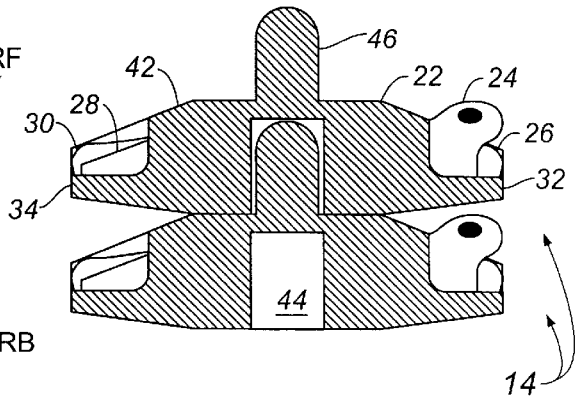
FIG. 3 is a lateral sectional view showing a pair of the game pieces in a stacked condition.
Figure 9:
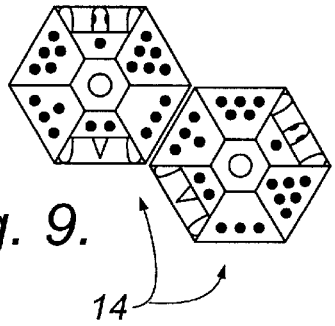
FIG. 9 is a plan diagram as in FIG. 4, showing the pair of game pieces in a like-facing hip-to-hip condition.
Figure 10:
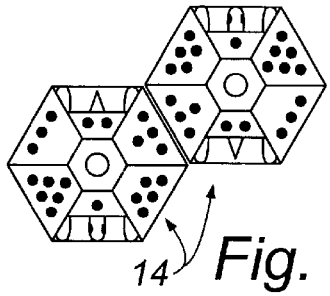
FIG. 10 is a plan diagram as in FIG. 4, showing the pair of game pieces in an oppositely facing hip-to-hip orientation.
Figure 8:
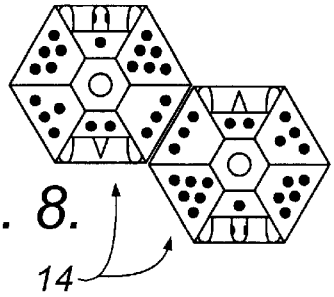
FIG. 8 is a plan diagram as in FIG. 4, showing the pair of game pieces in an oppositely facing shoulder-to-hip orientation.
Figure 7:
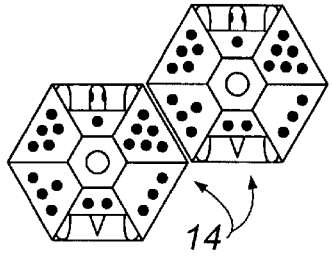
FIG. 7 is a plan diagram as in FIG. 4, showing the pair of game pieces in a like-facing shoulder-to-hip orientation.
Figure 4:
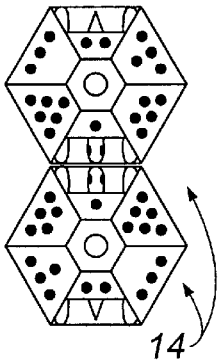
FIG. 4 is a plan diagram of an opposing pair of the game pieces in a head-to head orientation.
Figure 5:
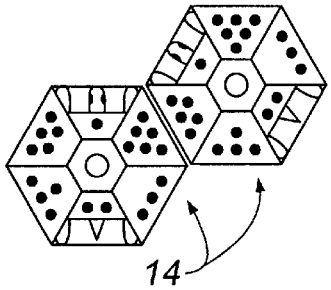
FIG. 5 is a plan diagram as in FIG. 4, showing the pair of game pieces in a like-facing shoulder-to-shoulder orientation.
Figure 6:
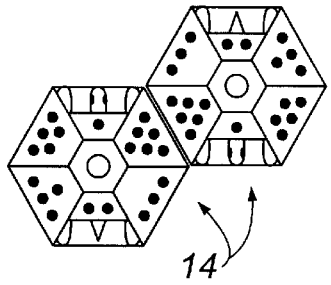
FIG. 6 is a plan diagram as in FIG. 4, showing the pair of game pieces in an oppositely facing shoulder-to-shoulder orientation.

The present invention is directed to a board game in which movements of game pieces between game-board positions is limited to subsets of possible directions of movement by previously selected orientations of the pieces. With reference to FIGS. 1–3 of the drawings, a board game apparatus 10 includes a game board 12 and a plurality of geometric game pieces 14, the board 12 having a playing region 16 defining an array of possible positions for the game pieces 14, the possible positions being delineated by respective indicia 18. It will be understood that the possible positions can also, or in the alternative, be defined by other features of the board such as depressions, protuberances, magnetic elements, and/or electrostatic elements. In the exemplary configuration of the apparatus depicted in the drawings, the game pieces are hexagonal in plan outline, and the indicia 18 form contiguous hexagonal array elements 20 of the playing region 16. Typically, the array elements 20 are slightly larger than the plan outline of individual game pieces 14 for allowing some deviation in the placement of game pieces without interference with other such pieces that occupy adjacent array elements 20. Thus each of the game pieces 14 can have six different orientations within any particular array element 20 in which it is placed. It will be understood that in general, the present invention contemplates at least two possible orientations of the game pieces 14 in the array elements 20. For example, the game pieces and the array elements can be rectangular or approximately so, such as for defining a serpentine path of piece positions, in which the pieces can have "forward" and "reverse orientations." Triangular and square plan outlines are also contemplated in addition to the hexagonal exemplary configuration. Other regular polygonal outlines, such as octagons are also possible, preferably with provision for overlapping of array elements, if necessary, for allowing adjacent placement of game elements. Further, neither the game pieces 14 nor the array elements 20 are necessarily required to be polygonal, as long as respective features of the game pieces and the array elements define plural permitted discrete orientations of the game pieces. Moreover, although selected orientations of the game pieces 14 define permitted directions of movement among possible directions as defined by the array elements 20 alone, other aspects of the game such as scoring can be selectively changed according to game piece orientations. In fact, the preferred exemplary configuration of the game apparatus 10 includes relative game piece orientation as affecting the outcomes of encounters between opposing game pieces as described further below.

As best shown in FIGS. 2 and 3, the exemplary game pieces 14 are shaped to simulate small turtles, each having a hexagonal "shell" portion 22, a forwardly exposed "head" portion 24 between a pair of front "feet" 26, and a rearwardly exposed "tail" portion 28 between a pair of rear feet 30. The head portion 24 is adjacent a front edge margin 32 of the game piece 14, the tail portion similarly being adjacent a rear edge margin 34. Further, respective left and right shoulder edge margins 36, individually designated 36L and 36R, extend from opposite ends of the front edge margin 32, and left and right hip edge margins 38, individually designated 38L and 38R, extend between opposite ends of the rear edge margin 34 and corresponding ends of the shoulder edge margins 36, these edge margins being respective hexagonal segments of the game piece plan outline.

The game pieces 14 have plural advancement directions associated therewith as signified by respective outwardly directed arrows in FIG. 2, each of the arrows being oriented normal to a corresponding edge margin of the preferred exemplary game piece 14. The particular directions being straight forward (SF), left forward (LF), right forward (RF), (collectively forward); and straight backward (SB), left backward (LB), and right backward (RB), (collectively backward), being directions respectively normal to the edge margins 32, 36L, 36R, 34, 38L, and 38R.

Preferably the game pieces 14 are appropriately configured, such as by having indicia 40 formed thereon for showing outcome-determining significance of the various possible orientations of each game piece 14. In the exemplary configuration, the indicia 40 are in the form of different numbers of dots signifying relative values to be associated with respective ones of the edge margins 32, 34, 36, and 38. More particularly, the indicia 40 are individually designated 40A, 40B, 40C, 40D, 40E, and 40F, correspondingly having one dot through six dots to signify values 1 through 6, as do the six faces of dice. Further, the indicia 40 are on respective upwardly and inwardly sloping faces 42 of the shell portion, these game pieces 14 also being appropriately referred to as "turtledice" (singular, turtledie).

As shown in FIG. 3, the game pieces 14 are also preferably configured for registered stacking, each having a central bottom opening registration cavity 44 and a central upstanding stem portion 46 that fits into the registration cavity 44 of another of the game pieces 14 being stacked thereon. The stem portions 46 also serve as convenient handles for manipulating the game pieces 14. If desired, the stem portions 46 can have snap engagement or other means such as a friction fit with the registration cavities 44 of other game pieces 44 for facilitating manipulation of stacked pluralities of the game pieces 14.

As further shown in FIG. 1, the playing region 16 has the hexagonal array elements 20 including groups of home elements or "burrows" 48, the burrows of particular groups being respectively designated 48A, 48B, 48C, and 48D. The burrows 48 of each group are suitably associated with "families" of the game pieces 14, such as by being correspondingly colored or otherwise identified, respective pairs of the families being also referred to as clans, for facilitating game play by both individuals and pairs of players. Accordingly, the burrows 48A are shown in FIG. 1 with horizontal fill lines, the burrows 48B having vertical fill lines, the burrows 48C having right upwardly diagonal fill lines, and the burrows 48D having left-upwardly diagonal fill lines, the fill lines signifying respective colors or other markings of the indicated array elements 20.

The burrows 48 are located along spaced perimeter portions of the playing region 18, being at respective outwardly projecting "corners" of the region 18 that is approximately rectangular in outline. Certain others of the array elements 20 have special significance, including a centrally located "trap" element 50 and a pair of "hazard" elements 52 that are located on opposite sides of the trap element 50. In the exemplary configuration, the trap element 50 is marked to depict a volcano, being referred to herein as "Suicide Volcano". Similarly, the hazard elements 52 are marked to simulate swamps, referred to as "green foreboding swamps." The game board depicts the playing region 16 as an island ("Turtledice Island") surrounded by a sea 54, with smaller islands 56 spaced outwardly from respective groups of the burrows 48.

As thus described, the preferred exemplary configuration of the game apparatus 10 provides Turtledice Island as home to four turtledice families or two clans. Each family typically has three turtledice of the same color, that of the corresponding burrows 48; The turtledice of each clan are also associatively identified such as by marking the stem portions thereof with the same color. Typically, the families (when there are four players) or the clans (when there are two players) have a hostile relationship, instinctively trying to remove each other from Turtledice Island as described below, those removed being dubbed "Turtle Soup".

With further reference to FIG. 11, an alternative configuration of the game board 12 has a different arrangement of the playing region 16. It will be appreciated that other arrangements are also possible and contemplated within the scope of the present invention.

Basic rules of play are as follows:

1. All games start with the turtledice in their burrows and rotated to move forwardly therefrom, the starting player being optional.
2. Each player in turn makes one move, which must be the rotation of one turtledie a single position left or right, or movement of one turtledie into an adjacent array element 20. If the adjacent array element is occupied by an opponent's turtledie, the moving player's turtledie must be able to remove that of the opponent.
3. For removal of an opposing turtledie, the moving turtledie must present an equal or greater number of dots on its facing edge margin then that presented by the opposing turtledie. The moving player says. "Turtle Soup", moving his turtledie (without rotation) into the vacated array element.
4. With one exception, turtledice move only forwardly (SF, LF, or RF), the exception being backward movement (SB, LB, or RB) when removing an opposing turtledie to the rear.
5. Two opposing turtledice nose-to-nose (kissing) render each other powerless until one is moved or rotated.
6. Unless it is a game objective, turtledice cannot move into a burrow of a different color.
7. Turtledice cannot move from one burrow directly into an adjacent burrow.
8. Turtledice cannot be rotated when occupying a hazard element 52 (green foreboding swamp), movement in and out only being permitted.
9. A turtledie moved into the trap element 50 (Suicide Volcano) is immobilized, remaining out of play.
10. Once a player moves or rotates one of his turtledice and removed his hand, the move is final.

Exemplary games to be played with the apparatus 10 of the present invention include Turtledice Survival, the turtledice maneuver around Turtledice Island to encounter and remove as many opponents as possible, each player attempting to keep his own family or clan intact. In this game a turtledie can leave and re-enter it own burrow at will, and the burrow is a safe haven against opposing turtledice; however, it can stay for three rotations but must leave the burrow in its next move.

Although the present invention has been described in considerable detail with reference to certain preferred versions thereof, other versions are possible. For example, three-dimensional configurations of the playing region 16 can be defined by intersecting tunnels in a transparent solid structure. Also, the game board 12 and/or the game pieces 14 can be remotely controlled such as by being appropriately interfaced with a personal computer or game console. The form of features such as the head, tail, and feet portions of the game pieces 14 can be surface markings and/or in other shapes than those shown in the drawings. Further, the plan outline of the game pieces 14 can be printed within outside extremities of the pieces, which can be round (with the array elements 20 being sufficiently large to show the relative orientations of game pieces located thereon). Therefore, the spirit and scope of the appended claims should not necessarily be limited to the description of the preferred versions contained herein.

What is claimed is:

1. A board game apparatus for opposing players comprising:

(a) a plurality of game pieces of non-circular plan outline, including at least two visually distinguishable types of the game pieces to be moved by the players, respective segments of the plan outline of each game piece having corresponding orientation indicia associated therewith, the orientation indicia of at least two of the segments being distinguishable from each other, each of the game pieces being configured with the plan outline having a front portion and a back portion for signifying respective forward and backward movement directions of the game piece;

(b) a game board having play region indicia defining an array of game piece positions and orientations, respective array elements of the array enclosing the plan outline of a game piece placed therein in one of a plurality of discrete orientations, whereby a comparison of facing orientation indicia of opposing game pieces occupying adjacent game piece positions is operable as an outcome determining factor of games played by the apparatus.

2. The game apparatus of claim 1, wherein the plan outline of each of the game pieces is polygonal, the array elements of the array being correspondingly polygonal.

3. The game apparatus of claim 2, wherein the orientation indicia of each game piece represent different numerical values.

4. The game apparatus of claim 2, wherein the plan outline is hexagonal and the array elements are hexagonal.

5. The game apparatus of claim 4, wherein the orientation indicia of each game piece represent the integers 1 through 6.

6. The game apparatus of claim 4, wherein the front portion of the plan outline includes left and right shoulder segments and a front segment, the back portion of the plan outline including left and right hip segments and a rear segment.

7. The game apparatus of claim 6, wherein the orientation indicia associated with the shoulder segments of each game piece are superior to the orientation indicia associated with the hip segments.

8. The game apparatus of claim 6, wherein the orientation indicia of each game piece represent the integers 1 through 6.

9. The game apparatus of claim 8, wherein the integers 1 through 6 are associated with the front, rear, shoulder, and hip edge margins, respectively.

10. The game apparatus of claim 1, wherein each of the game pieces is configured with a head portion in association with the front portion of the plan outline and a tail portion in association with the back portion of the plan outline.

11. The game apparatus of claim 10, wherein each of the game pieces is configured for depicting a turtle.

12. The game apparatus of claim 11, wherein each of the game pieces comprises a shell formation extending to proximate the plan outline.

13. The game apparatus of claim 12, wherein the shell portion includes six shell faces having the game piece indicia thereon.

14. The game apparatus of claim 1, wherein the array elements of the game board define respective home positions for the visually distinguishable types of game pieces.

15. The game apparatus of claim 14, wherein the home positions are at perimeter extremities of the array.

16. The game apparatus of claim 1, wherein the game pieces are configured for indicating permitted directions of movement of the pieces relative to the plurality of discrete orientations thereof.

17. A board game apparatus for opposing players comprising:

(a) a plurality of game pieces of non-circular plan outline, including at least two visually distinguishable types of the game pieces to be moved by the players, respective segments of the plan outline of each game piece having corresponding orientation indicia associated therewith, the orientation indicia of at least two of the segments being distinguishable from each other;

(b) a game board having play region indicia defining an array of game piece positions and orientations, respective array elements of the array enclosing the plan outline of a game piece placed therein in one of a plurality of discrete orientations, the array elements of the game board defining a hazard element signifying restricted mobility of a game piece located thereon, whereby a comparison of facing orientation indicia of opposing game pieces occupying adjacent game piece positions is operable as an outcome determining factor of games played by the apparatus.

18. The game apparatus of claim 17, wherein the array elements of the game board define a trap element signifying further restricted mobility of a game piece located thereon.

19. A board game apparatus for opposing players comprising:

(a) a plurality of game pieces of non-circular plan outline, including at least two visually distinguishable types of the game pieces to be moved by the players, respective segments of the plan outline of each game piece having corresponding orientation indicia associated therewith, the orientation indicia of at least two of the segments being distinguishable from each other, each of the game pieces further comprising an upstanding stem portion approximately centrally located thereon for facilitating manipulation of the game piece;

(b) a game board having play region indicia defining an array of game piece positions and orientations, respective array elements of the array enclosing the plan outline of a game piece placed therein in one of a plurality of discrete orientations, whereby a comparison of facing orientation indicia of opposing game pieces occupying adjacent game piece positions is operable as an outcome determining factor of games played by the apparatus.

20. The game apparatus of claim 19, wherein each of the game pieces is formed with an upwardly extending registration cavity for engaging the stem portion of another of the game pieces in stacked relation.

21. A board game apparatus for opposing players comprising:

(a) a plurality of game pieces of hexagonal plan outline, including at least two visually distinguishable types of the game pieces to be moved by the players, respective edge margin segments of each piece having corresponding orientation indicia associated therewith, the orientation indicia representing the integers 1 through 6, each of the game pieces further comprising:

(i) an upstanding stem portion approximately centrally located for facilitating manipulation of the game piece;

(ii) an upwardly extending registration cavity for engaging the stem portion of another of the game pieces in stacked relation;

(iii) each game piece being configured for depicting a turtle with the plan outline having a front portion having a head portion associated therewith, a back portion having a tail portion associated therewith for signifying respective forward and backward movement directions of the game piece, the front portion including left and right shoulder segments and a front segment of the plan outline, the back portion including left and right hip segments and a rear segment, and a shell formation extending to proximate the plan outline, the shell formation including six shell faces having the game piece indicia thereon, wherein the integers 1 through 6 are associated with the front, rear, shoulder, and hip segments of the edge margin, respectively;

(b) a game board having play region indicia defining an array of game piece positions and orientations, respective array elements of the array being hexagonal for enclosing the plan outline of a game piece placed therein in one of a plurality of discrete orientations, the array elements comprising:

(i) elements defining respective home positions for the visually distinguishable types of game pieces at perimeter extremities of the array;

(ii) a hazard element signifying restricted mobility of a game piece located thereon; and (iii) a trap element signifying further restricted mobility of a game piece located thereon, whereby a comparison of facing orientation indicia of opposing game pieces occupying adjacent game piece positions is operable as an outcome determining factor of games played by the apparatus.

22. The game apparatus of claim 21, wherein the integers 1 through 6 are associated with the front, rear, shoulder, and hip edge margins, respectively.

23. A method for playing a board game by opposing players comprising:

(a) providing a plurality of game pieces of non-circular plan outline having respective front portions and back portions for signifying respective forward and backward movement directions, including at least two visually distinguishable types of the game pieces to be moved by the players, respective segments of each piece proximate the plan outline thereof having corresponding orientation indicia associated therewith, the orientation indicia of at least two of the segments being distinguishable from each other;

(b) providing a game board having play region indicia defining an array of game piece positions and orientations, respective array elements of the array enclosing the plan outline of a game piece placed therein in one of a plurality of discrete orientations;

(c) selectively rotating a selected game piece in an array element occupied by the game piece from an initial one of the discrete orientations to a different one of the orientations;

(d) selectively moving a selected game piece from an array element occupied by the game piece to a different array element with movement in one of the forward and backward movement directions being restricted relative to the other of the forward and backward movement directions;

(e) comparing facing orientation indicia of opposing game pieces occupying adjacent game piece positions, if any; and (f) determining an outcome of the game resulting from the comparing.

24. The method of claim 23, further comprising removing one of the opposing game pieces based on the outcome, and moving the other of the opposing game pieces to the array element previously occupied by the removed game piece.

25. The method of claim 23, wherein the selectively moving is limited to directions being dependent on previous placement or rotation of the selected game piece.

26. The method of claim 25, wherein the selectively moving is limited differently in directions of adjacent distinguishable types of the pieces than for directions of adjacent unoccupied game piece positions.

27. A method for playing a board game by opposing players comprising:

(a) providing a plurality of game pieces of non-circular plan outline, including at least two visually distinguishable types of the game pieces to be moved by the players, respective segments of each piece proximate the plan outline thereof having corresponding orientation indicia associated therewith, the orientation indicia of at least two of the segments being distinguishable from each other;

(b) providing a game board having play region indicia defining an array of game piece positions and orientations, respective array elements of the array enclosing the plan outline of a game piece placed therein in one of a plurality of discrete orientations;

(c) selectively rotating a selected game piece in an array element occupied by the game piece from an initial one of the discrete orientations to a different one of the orientations;

(d) selectively moving a selected game piece from an array element occupied by the game piece to a different array element;

(e) comparing facing orientation indicia of opposing game pieces occupying adjacent game piece positions, if any; and (f) determining an outcome of the game resulting from the comparing; and (g) providing one of the array elements as a hazard element, and limiting at least one aspect of the selectively rotating and selectively moving of a game piece occupying the hazard element.

28. The method of claim 27, wherein the limiting comprises preventing the selectively rotating.

29. The method of claim 27, further comprising providing one of the array elements as a trap element and further limiting the selectively rotating and the selectively moving of a game piece occupying the trap element.

30. The method of claim 27, wherein the further limiting comprises preventing both the selectively rotating and the selectively moving.

31. The method of claim 27, further comprising removing one of the opposing game pieces based on the outcome, and moving the other of the opposing game pieces to the array element previously occupied by the removed game piece.

32. The method of claim 27, wherein the selectively moving is limited to directions being dependent on previous placement or rotation of the selected game piece.

* * * * *